US011761254B2

(12) United States Patent
Romaszko et al.

(10) Patent No.: US 11,761,254 B2
(45) Date of Patent: Sep. 19, 2023

(54) METHOD AND DEVICE FOR DETECTING POTENTIAL PINCHES

(71) Applicant: Aptiv Technologies Limited, St. Michael (BB)

(72) Inventors: Mateusz Romaszko, Cracow (PL); Grzegorz Wyszynski, Cracow (PL)

(73) Assignee: Aptiv Technologies Limited, St. Michael (BB)

( * ) Notice: Subject to any disclaimer, the term of this patent is extended or adjusted under 35 U.S.C. 154(b) by 144 days.

(21) Appl. No.: 17/473,439

(22) Filed: Sep. 13, 2021

(65) Prior Publication Data

US 2022/0154510 A1 May 19, 2022

(30) Foreign Application Priority Data

Nov. 17, 2020 (EP) ..... 20208150

(51) Int. Cl.
*E05F 15/00* (2015.01)
*E05F 15/40* (2015.01)

(52) U.S. Cl.
CPC ..... *E05F 15/40* (2015.01); *E05Y 2400/35* (2013.01); *E05Y 2400/54* (2013.01); *E05Y 2900/55* (2013.01)

(58) Field of Classification Search
CPC ... E05F 15/00; E05F 5/40; E05F 15/41; E05F 15/42; E05Y 2400/35; E05Y 2400/354;
(Continued)

(56) References Cited

U.S. PATENT DOCUMENTS 4,641,067 A 2/1987 Iizawa et al.
5,399,950 A 3/1995 Lu et al.
(Continued)

FOREIGN PATENT DOCUMENTS

CN 101220724 7/2008
CN 202899882 4/2013
(Continued)

OTHER PUBLICATIONS

"Extended European Search Report", EP Application No. 20208153.5, dated May 11, 2021, 7 pages.
(Continued)

*Primary Examiner* — Chi Q Nguyen
(74) *Attorney, Agent, or Firm* — Sawtooth Patent Group PLLC

(57) ABSTRACT

A method for detecting potential pinches caused by at least one powered movable panel between a closed position and an open position, using a round including measuring a physical quantity, representative of a panel movement, when the panel is moved towards the closed position, determining if there is a lack of steadiness in said physical quantity relative to a previous round and, if not, starting a new round, determining if said lack of steadiness was already present during the previous round and, if not, storing at least one current parameter specific to the panel movement as a reference value, and starting a new round, and detecting a potential pinch if a second difference between the current parameter and the reference value is greater than or equal to a pinching threshold value, otherwise starting a new round.

9 Claims, 6 Drawing Sheets

(58) Field of Classification Search
CPC ..... E05Y 2400/356; E05Y 2400/54; E05Y 2400/58; E05Y 2900/55; H02H 7/0851
See application file for complete search history.

(56) References Cited

U.S. PATENT DOCUMENTS

| | | | | |
|---|---|---|---|---|
| 5,734,245 | A | 3/1998 | Terashima et al. | |
| 5,977,732 | A | 11/1999 | Matsumoto | |
| 6,051,945 | A | 4/2000 | Furukawa | |
| 6,208,102 | B1 | 3/2001 | Kikuchi et al. | |
| 6,239,610 | B1 | 5/2001 | Knecht et al. | |
| 6,274,947 | B1 * | 8/2001 | Terashima | H02H 7/0851 318/266 |
| 6,362,584 | B1 | 3/2002 | Rogovin | |
| 6,573,677 | B2 | 6/2003 | Gerbetz | |
| 6,633,147 | B2 | 10/2003 | Gerbetz | |
| 6,794,837 | B1 | 9/2004 | Whinnery et al. | |
| 8,620,531 | B2 | 12/2013 | Morawek | |
| 10,047,553 | B2 * | 8/2018 | Shibata | H02P 3/08 |
| 10,337,230 | B2 | 7/2019 | Kigoshi et al. | |
| 11,454,061 | B2 * | 9/2022 | Fujita | E05F 15/695 |
| 11,572,728 | B2 | 2/2023 | Kim et al. | |
| 11,581,829 | B2 | 2/2023 | Romaszko et al. | |
| 2002/0101210 | A1 | 8/2002 | Boisvert et al. | |
| 2002/0190680 | A1 | 12/2002 | Gerbetz | |
| 2003/0051555 | A1 | 3/2003 | Fukumura et al. | |
| 2004/0079867 | A1 * | 4/2004 | Le Gallo | E05F 15/431 250/221 |
| 2005/0187688 | A1 | 8/2005 | Bigorra et al. | |
| 2006/0267453 | A1 * | 11/2006 | Sugiura | H03K 17/964 310/319 |
| 2006/0293821 | A1 * | 12/2006 | Takahashi | H02H 7/0858 701/49 |
| 2008/0079379 | A1 | 4/2008 | Odland et al. | |
| 2009/0056385 | A1 | 3/2009 | Maekawa | |
| 2010/0039057 | A1 * | 2/2010 | Tsai | H02P 7/2805 318/434 |
| 2011/0210755 | A1 * | 9/2011 | Ogawa | E05F 15/46 324/686 |
| 2011/0265381 | A1 | 11/2011 | Guarnizo | |
| 2012/0032618 | A1 | 2/2012 | Stoeger | |
| 2014/0173984 | A1 | 6/2014 | Schlesiger et al. | |
| 2014/0239867 | A1 * | 8/2014 | Bessho | E05F 15/40 318/466 |
| 2017/0113652 | A1 * | 4/2017 | Tokudome | B60R 25/2054 |
| 2020/0018111 | A1 * | 1/2020 | Akbarian | E05F 15/73 |
| 2020/0249752 | A1 * | 8/2020 | Parshionikar | G06F 1/163 |
| 2023/0062859 | A1 * | 3/2023 | Gowda | E05F 15/695 |

FOREIGN PATENT DOCUMENTS

| | | |
|---|---|---|
| DE | 19601359 | 7/1997 |
| DE | 102009028914 | 3/2011 |
| DE | 102012011117 | 12/2013 |
| EP | 0692856 | 1/1996 |
| EP | 2175330 | 4/2010 |

OTHER PUBLICATIONS

"Extended European Search Report", EP Application No. 21204569.4, dated Mar. 21, 2022, 8 pages.
"Extended European Search Report", EP Application No. 20208151.9, dated Apr. 28, 2021, 7 pages.
"Extended European Search Report", EP Application No. 20208149.3, dated Apr. 30, 2021, 6 pages.
"Extended European Search Report", EP Application No. 20208152.7, dated May 3, 2021, 6 pages.
"Extended European Search Report", EP Application No. 20208150.1, dated Apr. 30, 2021, 7 pages.
"Foreign Office Action", EP Application No. 20208151.9, dated May 31, 2023, 4 pages.

* cited by examiner

X-axis
ia [A]
C2
Δ1 [A]
C3
A
B
C
D
E
F
Th1
Th1'
TR
Ms
$X_B$
$X_C$
$X_E$
$X_F$
t [s]

METHOD AND DEVICE FOR DETECTING POTENTIAL PINCHES

CROSS-REFERENCE TO RELATED APPLICATION

This application claims priority to European Patent Application Number 20208150.1, filed Nov. 17, 2020, the disclosure of which is hereby incorporated by reference in its entirety herein.

BACKGROUND

The present disclosure relates to the field of powered movable panel, especially panels or opening and closing members such as power windows, sliding doors or sliding roofs of vehicles, which are provided with anti-pinch mechanisms to provide protection against injuries. More specifically, the present disclosure relates to a method for detecting potential pinches caused by at least one powered movable panel, a pinch detector for implementing said method, a vehicle comprising such a pinch detector, and a non-transitory computer-readable medium comprising computer-executable instructions for carrying out the aforementioned method.

Power windows are getting very popular nowadays, even on the budget vehicles. The power window typically uses an electric motor to operate. It is known that children prefer to watch out through windows of the vehicle while trying to put their neck or hands out through the window. If anyone operates the window switch accidentally to close the window; the latter may cause suffocation or injuries to the child. The risk also arises in case of power windows which are programmed to operate without even the need to press the switch, for example when a global closing function is activated.

Windows are moved with clamping forces of up to 350 N. This means that a thin glass plate of only about 8 mm thickness can press up to 35 kg e.g. onto a child's hand or head. It takes just 98 N to suffocate or injure a small child. To avoid such mishaps, engineers invented the anti-pinch technology.

The anti-pinch technology of a power window has to meet standards typically issued by countries such as the United States and the European Union states. In some of such countries, the maximum force a power window is allowed to exert on any object is 100 N. Compliance with this limit must be monitored and enforced in a range of 4 mm to 200 mm minimum from the top window frame. It is also important to deactivate the anti-pinch algorithm immediately before the window seal is reached (distance 4 mm from top seal), so that the window can close completely. In addition, to avoid overload and damage to the window motor, blocking must not last too long.

To control anti-pinch in power window, some known solutions are based on measurement of pinching force caused by the power window when it is closed. However, such a way can be regarded as an indirect solution since it requires an additional device for measuring the window force.

Document US2014239867 discloses a pinch detection apparatus which has a reference data storage portion calculating load data on the basis of a rotation speed of the motor actuating the window and an environmental temperature.

Document US2003051555 discloses a solution based on the calculation of reference motor torque using voltage and speed measurements. To this end, it requires at least one dedicated speed sensor, such as an encoder or a Hall effect sensor, which determines the rotational speed of the motor. A voltage sensor provides information to a force calculator which calculates the motor force. A difference between an actual force and a reference force can thus be determined. A pinch condition is indicated by a pinch detector if the force difference exceeds a predetermined threshold.

Document U.S. Pat. No. 6,239,610 discloses a solution based on the voltage induced in the armature motor of the electric drive system used for moving the window.

Requiring additional equipment such as force or speed sensors, involves additional costs, takes more space in relatively confined areas, and does not allow to increase the reliability of the entire system. To overcome these drawbacks, document CN101220724A suggests a solution requiring no sensor. To this end, it discloses a method in which a sampling resistance and a magnifying filter circuit are adopted to obtain the armature current signal of a motor used for moving the window. The armature voltage of the current is obtained by an amplifier. A chip utilizes an A/D converter to obtain the digital values of the armature voltage and current. The rotation speed of the motor is obtained thanks to a functional relationship based on the armature voltage and current. The rotor position is calculated by the integral of the rotation speed and thereby the position of the window can be obtained. The chip can determine if the motion of the window is obstructed thanks to a motion condition and the window position. Accordingly, no sensor is required in this solution.

Most of known solutions are based on comparisons of data measured when closing the window with pre-stored factory values set by the manufacturer. However, such an approach fails to consider the impact of temperature and aging of materials such as gaskets and other plastic components for example. Expansion and change in the coefficient of friction or sliding of the materials in contact with the window have non-negligible influences that distort the comparisons, especially because factory values were established under different conditions.

Accordingly, there is a need for improving existing anti-pinch solutions in order to at least partially overcome the aforementioned issues and drawbacks, especially to improve safety on board the vehicle while complying with the most stringent regulations.

SUMMARY OF THE SOLUTION

To address this concern, the present disclosure suggests, as a first aspect, a method for detecting potential pinches caused by at least one powered movable panel, said panel being movable in a time or panel position domain between an open position and a closed position. The method includes a round including measuring a physical quantity, representative of a panel movement, when the panel is moved towards the closed position within said time or panel position domain; determining if there is a lack of steadiness in said physical quantity relative to a previous round and, if not, starting a new round; determining if said lack of steadiness was already present during the previous round and, if not, storing at least one current parameter specific to the panel movement as a reference value, and starting a new round; and detecting a potential pinch if a second difference between the parameter, at the present time, and the reference value is greater than or equal to a pinching threshold value, otherwise starting a new round.

Thanks to the above solution, the physical quantity, such as the armature current or the speed of the electric motor acting as actuator for moving the powered panel 1, can be easily monitored in order to determine its steadiness. Indeed, by comparing the current (i.e. actual) value of the physical quantity with at least one previous value, preferably with the last measured value of the physical quantity, it becomes possible to detect a potential pinch. If the compared values are the same or almost the same within a certain margin, it may be determined that no obstacle 4 hinders the movement of the panel 1. In contrast, if the measured physical quantity shows a lack of steadiness with respect to the previous recent value(s), typically by deviating or moving out of the aforementioned margin, a potential pinch of an obstacle 4 may then be detected.

Advantageously, the present solution is both simple and fast, requires low resource consumption and is easy to deploy at final hardware. This solution is also reliable since it was faultless in most life scenarios. In addition, this solution provides an up-to-date approach, namely an approach that depends on the current physical characteristics of the materials involved during the closure movement of the panel, instead of being based on factory-set parameters. This allows considering the conditions of the moment, especially in terms of temperature, supply voltage (e.g. depending on the battery charging level) and aging of the seals.

According to one embodiment, the time or panel position domain has at least one first exclusion zone, at least bounded by one of extremities of the time or panel position domain, and preferably at least one second exclusion zone, at least bounded by an activation of the powered movable panel, in which an execution of the round is suspended.

Preferably, one first exclusion zone extends over a range of 4 mm from a fully closed position and, if any, the other first exclusion zone extends over a range from a fully open position which does not extend beyond 200 mm from the fully closed position.

According to another embodiment, the second exclusion zone extending over a range equivalent to 0.2 to 0.5 seconds from the activation of the powered movable panel.

In a further embodiment, measuring the physical quantity when the panel is moved towards the closed position is carried out on a continuous basis or almost continuous basis, namely on a substantially continuous basis.

Preferably, the physical quantity is an armature current of an electric motor used to operate the panel.

Still preferably, if the physical quantity is the armature current as mentioned above, the step for determining if there is a lack of steadiness in the physical quantity is performed by calculating a first difference between the physical quantities measured at two successive rounds and determining that there is a lack of steadiness if said first difference is greater than or equal to a first threshold value and, if not, starting a new round.

In one embodiment, the physical quantity is a speed of a panel movement or of an electric motor used to operate the panel, and the second difference between the panel parameter at the present time and the reference value is an multiplied by minus one before being considered.

Preferably, if the physical quantity is a speed as mentioned above, the step for determining if there is a lack of steadiness in the physical quantity is performed by calculating a first difference between the physical quantities measured at two successive rounds and determining that there is a lack of steadiness if said first difference is less than or equal to a first threshold value and, if not, starting a new round.

Preferably, the step for determining if there is the lack of steadiness was already present during the previous round is performed by incrementing a counting value initially reset during an initialization step at the beginning of the method, and determining that the lack of steadiness was already present if said counting value is greater than a second threshold value.

In a further embodiment, the round further includes a step for ending the method if a current panel position reaches the closed position or a position close to said closed position, said step being performed before starting each new round.

According to a second aspect, the present disclosure relates to a pinch detector for implementing the method for detecting potential pinches caused by at least one powered movable panel according to any of embodiment or possible combination of embodiments of the related method, said panel being movable by an actuator in a time or panel position domain between an open position and a closed position, the pinch detector comprising a measuring device for obtaining measurements of a physical quantity representative of a panel movement, and a processing device for performing calculation tasks in order to at least determine if there is a lack of steadiness in the physical quantity relative to the previous measurement; determine if said lack of steadiness was already present during the previous measurement; and detect a potential pinch if said lack of steadiness is greater than or equal to a pinching threshold value.

In one embodiment, the pinch detector generates a control signal for controlling at least one of the two actions of stopping the movement of the powered movable panel and moving the powered movable panel towards the open position.

In a third aspect, the present solution relates to a vehicle comprising the pinch detector according to any of its embodiment or combination of its embodiments.

In a fourth aspect, the present solution relates to a non-transitory computer-readable medium comprising program instructions for causing a processor to execute the method according to any of its embodiment or any possible combination of its embodiments.

Other embodiments and advantages will be disclosed hereafter in the detailed description.

BRIEF DESCRIPTION OF THE DRAWINGS

The solution and the embodiments suggested in the present disclosure should be taken as non-limitative examples and will be better understood with reference to the attached Figures in which.

AUTOMOTIVE FIELD

The solution proposed in this presentation is primarily applied to a power window of a motor vehicle. However, it should be understood that it is neither limited to a power window, nor limited to be mounted on a motor vehicle. Indeed, the powered movable panel may refer to any kind of motorized panel, for example a sliding roof or door of a space that can be closed, a sliding swinging or tilting gate, an electrical garage door, a sliding door of a van or a door made of two movable panels such as a two-way door.

Figure 1:
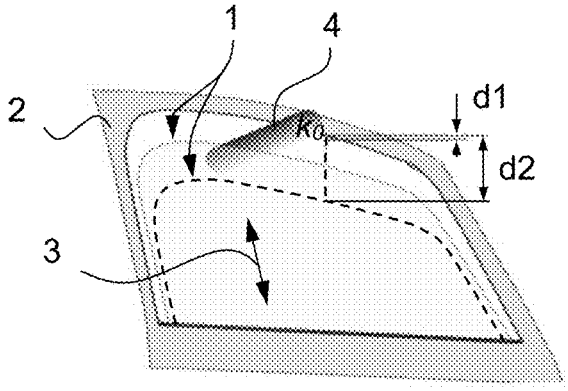
FIG. 1 is a schematic representation of a scene showing a pinch of an object in a car door window.

In the example of FIG. 1, a power window of car door is shown as powered movable panel 1, namely as a powered opening and closing member. The door may be regarded as an armature or a fixed frame 2 relative to the panel 1. This panel 1 is movable, along a panel stroke, in a panel position domain between a closed position and an open position. The closed position may be a fully closed position, namely a position that completely closes the frame 2. Similarly, the open position may be a fully open position, namely the most open position available within the frame 2. Alternatively, the open and closed positions may refer to partly open and partly closed positions. In FIG. 1, the window movement is a vertical movement according to the double arrow 3, where the closed position is located at the top of the frame 2 or near the top of the frame, and the open position is located at the bottom of the frame 2 or near the bottom of this frame.

In the automotive field, the anti-pinch technology of a power window has to meet standards issued by the European Union and the United States, among others. The maximum force a power window is allowed to exert on any object acting as obstacle 4 is 100 N. Compliance with this limit must be monitored and enforced in a range of 4 mm to 200 mm minimum from the top window frame as it is shown in FIG. 1 respectively through the distances d1 and d2. To allow the window to be completely closed, it is also important to deactivate the anti-pinch system or to make it ineffective immediately before the frame 2 (seal) is reached by the window near its fully closed position. This is the reason why the system will preferably have no effect within a distance of 4 mm from the top of the frame 2. In addition, to avoid overload and damage to the window motor, blocking the window must not last too long, regardless of its position along its stroke.

First Aspect

According to the first aspect, the present solution relates to a method for detecting potential pinches, more specifically at least one pinch or potential pinch, caused by at least one powered movable panel 1. For example, the present method may detect potential pinches between a powered movable panel 1 and a fixed frame 2 relative to this panel 1. Preferably, the panel 1 is powered by an actuator such as an electric motor. Nevertheless, other kind of actuator may be considered, e.g. pneumatic or hydraulic cylinder or an actuator comprising a combination of electric and pneumatic or hydraulic elements, if applicable. In the following description, the case of an electrical actuator, especially an electric motor such as a DC motor, will be considered since it is one of the preferred embodiments.

Figure 2:
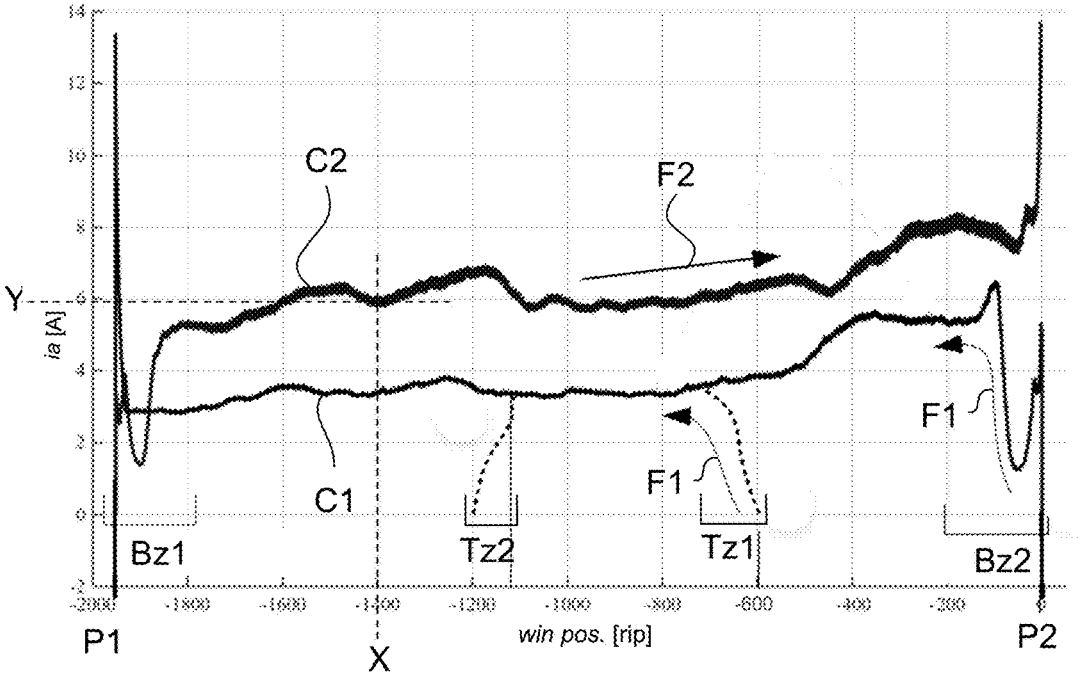
FIG. 2 is a graph showing the armature current variations in an electrical motor during opening and closing movements of a power window.

Referring to FIG. 2, the latter provides a graph showing the armature current ia variations in an electrical motor that has been used as window actuator, during opening and closing movements of the power window 1. More specifically, the lower curve C1 shows the intensity of the armature current ia in the time or window position domain when the window is moved towards its open position P1, as shown through the arrows F1, whereas the upper curve C2 shows the intensity of the armature current ia when the window is moved towards its closed position P2, as shown through the arrow F2. The intensity values of the armature current ia have been measured in a substantially continuous way during the movements of the window 1. Accordingly, this graph shows the window positions X [rip] on the X-axis and the armature current intensity [A] on the Y-axis.

The closed position P2, in particular the fully closed position, is located on the right side of the X-axis, whereas the open position P1, in particular the fully open position is located on the left-side of the X-axis. The range between the closed and open positions is referred as the time or panel position domain, more specifically the time or window position domain in this case. Accordingly, the time or panel position domain may be denoted X-axis. This domain extends e.g. from X=0 to X=−2000 ripples, where the value of 0 ripple corresponds to the fully closed position P2 and the value of −2000 ripples corresponds to the fully open position P1 in this example.

The ripple unity may be regarded as a quantity for defining the position X of the window along its stroke which, in the present example, cannot extend beyond 2000 ripples. More specifically, current fluctuations caused by motor commutations, typically in a DC motor, are referred to as current ripples and may be used, as a sensorless solution, to identify the position of the movable panel (e.g. the powered window) in the time or panel position domain X-axis. Other unity such as the time in second or the millimeter or encoding values may be also used for uniquely defining the position of the window along its stroke, i.e. within the time or window position domain. Accordingly, any dedicated sensor, such as a Hall sensor for example, may be provided for determining the position of the movable panel in the time or panel position domain.

Instead of the panel position domain, one may refer to a time domain typically expressed in seconds. Time domains (X-axis) are used in the graph examples shown at FIGS. 5A to 5C and at FIG. 6. The range of the time domain may correspond to the entire panel stroke for moving the panel between the open position P1, preferably its fully open position, and the closed position P2 such as its fully closed position. Alternatively, the range of the time domain may start when the panel 1 begins to move from a partly open position P1 and may end e.g. when the panel reaches its fully closed position P2. In practice, it should be noted that the physical quantity is measured in a time domain due to a constant or regular sampling time on a micro-processor in charge of clocking the measurement process. Accordingly, the physical quantity is preferably measured in time domain even if they can be presented in panel position domain.

In a known way, there are at least two zones located at the extremities of the window position domain X-axis in which the physical quantity (e.g. ia [A]) representative of the window movement is disturbed. These zones may be also located at the extremities of the window stroke, i.e. at the extremities of the window movement if the window stroke is shorter than the whole time or window position domain. These two zones are referred as blind zones as shown in FIG. 2 through the reference Bz1 (bottom blind zone) and Bz2 (top blind zone). In these two zones, the window is in the final phase of complete closing or opening and, as shown in FIG. 2, there are rapid changes in the current intensity which are not significant in the present method for detecting a potential pinch. Therefore, top, and bottom blind zones will preferably be avoided.

In addition, when the window starts moving either towards its open (or fully open position) or towards its closed position (or fully closed position), the armature current intensity ia needs a certain time interval in order to be stabilized. Such a phenomenon is due to several parameters such as the inertia of the window (inertia of the powered movable panel 1), the inertia of the motor rotor (or any other actuator), frictions to overcome or the peak current of the motor when starting. This may occur not only within the blind zones Bz1, Bz2, but also at any position X within the time or window position domain. For example, this can occur through transient states Tz of the motor, typically when the motor starts (or accelerates) or when the motor brakes (or decelerates) during a window opening movement. For the same reason as that mentioned in connection with the blind zones, transient zones Tz1, Tz2 resulting from transient states should preferably be avoided.

Method Round

Figure 3:
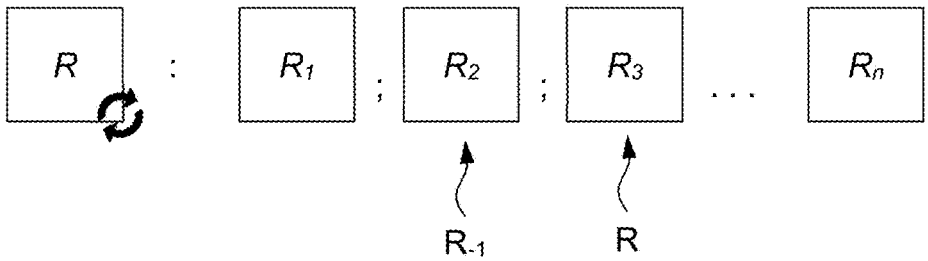
FIG. 3 is a schematic representation of a round of an example method, which is successively repeated, FIG. 4A provides a flow chart of the method according to a preferred embodiment, FIG. 4B relates to a variant of the embodiment shown in FIG. 4A, FIG. 5A to 5C provide respectively a first graph showing the variations of the armature current variations taken as physical quantity monitored during the time or panel position domain, a second graph showing the variations of a first difference between the armature current measured at two successive rounds according to a repeated basis within the same domain, and a third graph showing a so-called monitoring signal thanks to which a potential pinch may detected.

FIG. 3 is a schematic representation of a round R of an example method, which is successively repeated, as schematically depicted through the pictogram showing a circular repetition by means of the two rotating arrows applied onto the round R. The first time the round R is performed is referred to as round $R_1$ in FIG. 3. The round $R_1$ may be fully or partly executed, depending on the results of some tests executed within the round. When a new round is executed, the new round is denoted in FIG. 3 as round $R_2$, then $R_3, \ldots$, until $R_n$. It should be noted that even if it is referred to as a "new" round, the executed round R remains the same but is simply run again. Since nothing differ within the round between successive rounds $R_1, R_2, R_3, \ldots R_n$, the current round, i.e. the round that is currently executed by the method, is simply referred to as round R and a previous round, especially the previous round closest to the current round, is denoted $R_{-1}$. The second previous round closest to the current round R could be denoted $R_{-2}$ and so on. In addition, it should be noted that the round R may be regarded as a cycle or as a routine which can be repeated as long as necessary.

Main Steps of the Method

Figure 4A:
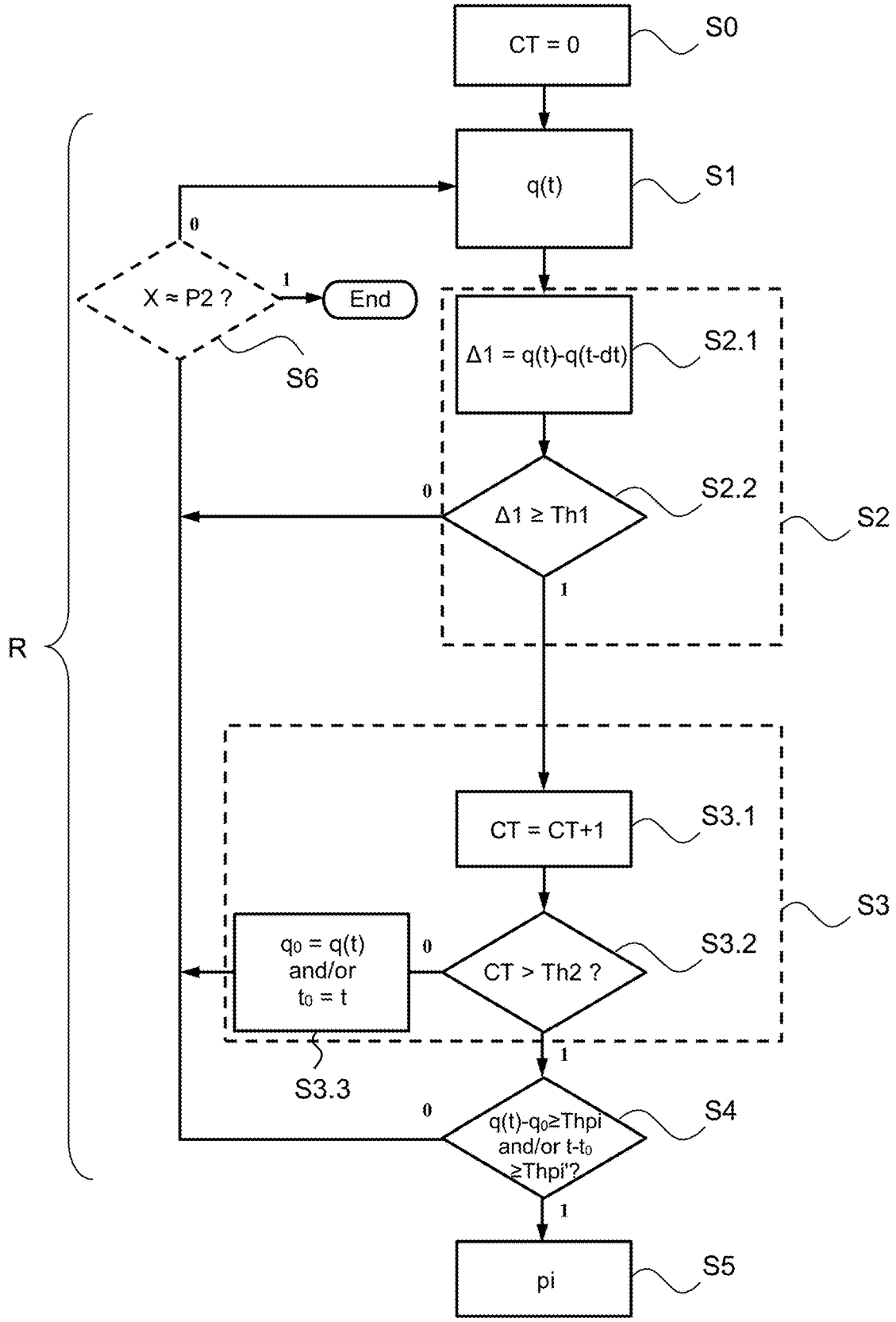
Figure 7:
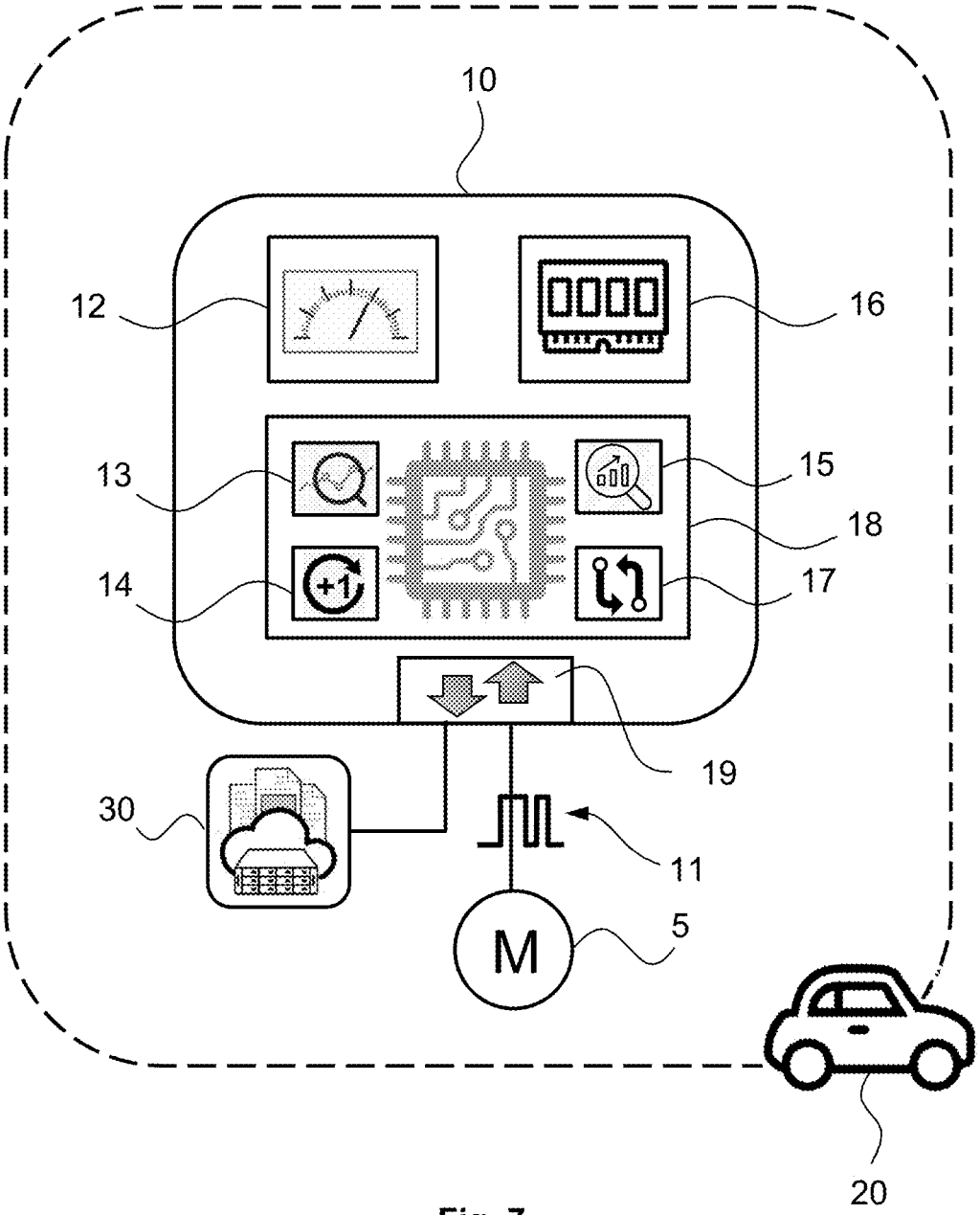

Generally speaking, the present method has several steps, denoted S1, S2, S3 and so on, which will be successively described according to a preferred order, especially in connection with FIG. 4A. Nevertheless, the steps of the present method are not limited to be carried out in the same order if one or more steps could take place in a different order. Most of the steps of this method are part of the round R, as depicted through the brace or curly bracket shown in FIG. 4A. The steps of the method may be implemented by a pinch detector 10, as shown in FIG. 7 which will be described in more detail at the end of this disclosure.

The first step S1 of the round R aims to measure a physical quantity q which is representative of the movement of the powered movable panel 1. Typically, such a physical quantity q may be the current of the motor used as actuator, especially the armature current ia of such a motor, as shown in most of the annexed Figures. Nevertheless, another physical quantity such as the speed of the panel 1 or the rotational speed n of the motor (actuator) could be also used. Measuring the physical quantity q is carried out at a plurality of panel positions $X_1, X_2, X_3, \ldots, X_n$ when the panel 1 is moved at least towards the second position P2, i.e. the closed position, within the time or panel position domain X-axis. The first main step S1 may be performed by a measuring device 12, as shown in FIG. 7.

Preferably, the related value Y of the measured physical quantity q is at least temporarily stored, e.g. in a register, in view to achieve the second main step S2. In FIG. 4A, the second step S2 is depicted using a dashed line including several sub-steps S2.1 to S2.2 which, in part, relate to a preferred embodiment that will be presented later in the present description. The same is true regarding the third step S3.

The second main step S2 of the round R aims to determine if there is a lack of steadiness in the aforementioned physical quantity q relative to at least one previous round, preferably relative to the closest previous round $R_{-1}$, more specifically relative to the previous measurement of the physical quantity q made during the closest previous round. If no lack of steadiness could be found, a new round R is started by going back to the first step S1. Otherwise, i.e. if there is a lack of steadiness, the round continues through the third main step. The second main step S2 may be performed by a processing device 18, such as a processor or a chipset, or by a monitoring device 13, as shown in FIG. 7

The third main step S3 aims to determine if the observed lack of steadiness was already present during the aforementioned previous round $R_{-1}$ and, if not, a sub-step S3.3 is executed before starting a new round R as shown in FIG. 4A.

The sub-step S3.3 aims to store at least one current parameter specific to the panel movement as a reference value. The current parameter is an actual parameter, i.e. a parameter existing at the present time, and may be the current time (e.g. in seconds) within the time domain X-axis, or the physical quantity q(t) at that time. Accordingly, the current parameter may be denoted q(t) or t, and the reference value used as a variable to memorize this current parameter may be respectively denoted $q_0$, $t_0$. Therefore, the reference value $q_0$ can be regarded as being a recording of the physical quantity q(t) at a time t, namely at the instant t where the physical quantity q has been measured during the first step S1 of the present round R. However, if the observed lack of steadiness was already present during the previous round $R_{-1}$, sub-step S3 is not executed and the round R continues to the fourth main step S4. The third main step S3 or any of its sub-step may be performed using a counter 14, as shown in FIG. 7.

At the fourth main step S4, a potential pinch pi is detected if a so-called second difference Δ2 between the parameter q(t), t at the present time t, and the reference value $q_0$, $t_0$ is greater than or equal to a pinching threshold value Thpi, Thpi', otherwise a new round R is started. In other words, the condition to detect a pinch pi may be written by the following expression: there is a pinch pi if $q(t)-q_0 \geq Thpi$ and/or $t-t_0 \geq Thpi'$. The pinching threshold value Thpi, Thpi' is typically an invariable value that may be determined in advance for defining the size of an observed variation of the physical quantity beyond which a potential pinch should be detected. This would be better explained latter in connection with FIG. 6. The fourth main step S4 may be performed by a detector 15 and, if needed, by a comparator 17 as shown in FIG. 7 and explained in connection with the second aspect of the present solution.

Once a potential pinch pi is detected, several actions may be undertaken at step S5 in order to prevent injuries or undesirable harms.

It should be noted that different wordings may be used for defining some of the steps of the round R while keeping the same effects. For instance, one could consider whether there is a steadiness in the physical quantity, instead of a lack of steadiness, and adapting the response accordingly.

Main Advantages

Advantageously, this method provides at any time an up-to-date solution given that the physical quantity monitored by the repeated measurements, made at each round R when the movable panel 1 is moved towards its closed position P2, is compared with a recent previous value. Such a comparison is achieved to determine whether a local steadiness can be observed or, on the contrary, whether there is locally an increase or a decrease of the monitored physical quantity, namely a variation in the physical quantity that cannot be considered to be within an acceptable variation tolerance in order to still be defined as constant.

Accordingly, the monitoring process of the round considers the current environmental conditions, such as temperature, battery voltage, ageing of the joints, gaskets or any part of the mechanism that allows to actuate the movable panel. In other words, each time the panel 1 is actuated, the algorithm that monitors the movable panel automatically takes into account these intrinsic parameters which may have a significant influence on the detection of any potential pinch during the closing movement of the panel. By monitoring the steadiness of at least one physical quantity representative of the movement of the powered movable panel when it moves towards its closed position P2, the present method provides a new approach for efficiently detecting any potential pinch. The present solution has the advantage of being easily adaptable to any kind of movable panel. In addition, it should be noted that this method may be easily implemented using an algorithm based on mathematical functions, expressions and/or comparisons, and that the order in which some of these operations are executed may vary while obtaining the same result. In any case, the method is simple, quickly provides results with few computing resources and is easy to deploy regarding the required hardware.

Graphs Based on the Armature Current

The armature current ia of the motor used as actuator of the powered panel 1 is an example of physical quantity monitored within the time or panel position domain X-axis. As already mentioned, the rotational speed of this motor may be used instead of the armature current. In order to better explain the variations of such a physical quantity in the aforementioned domain, the graphs shown at FIGS. 5A to 5C and at FIG. 6 are based on such an armature current ia as example of the physical quantity q.

Figures 5A, 5B, 5C:
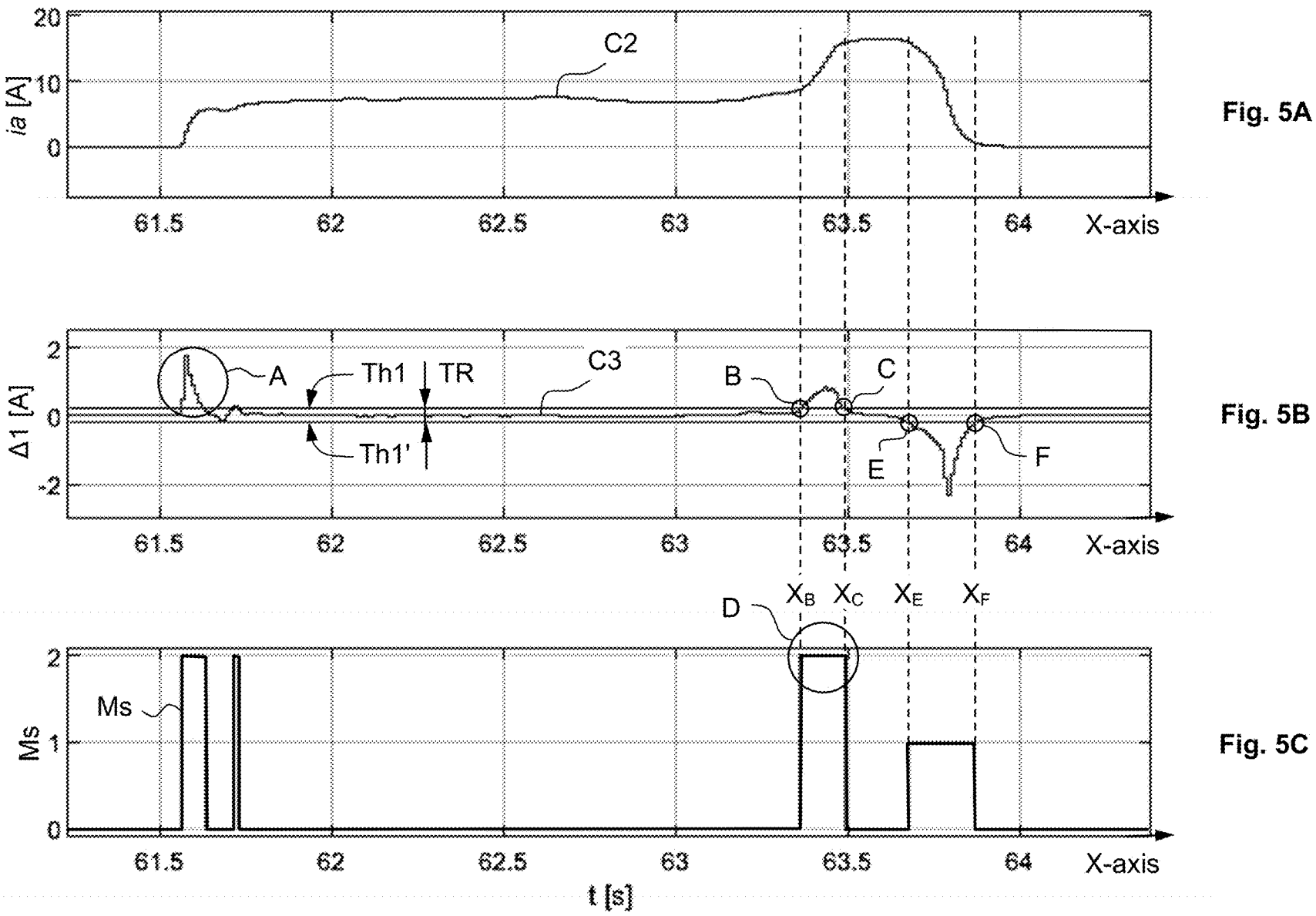
Figure 6:
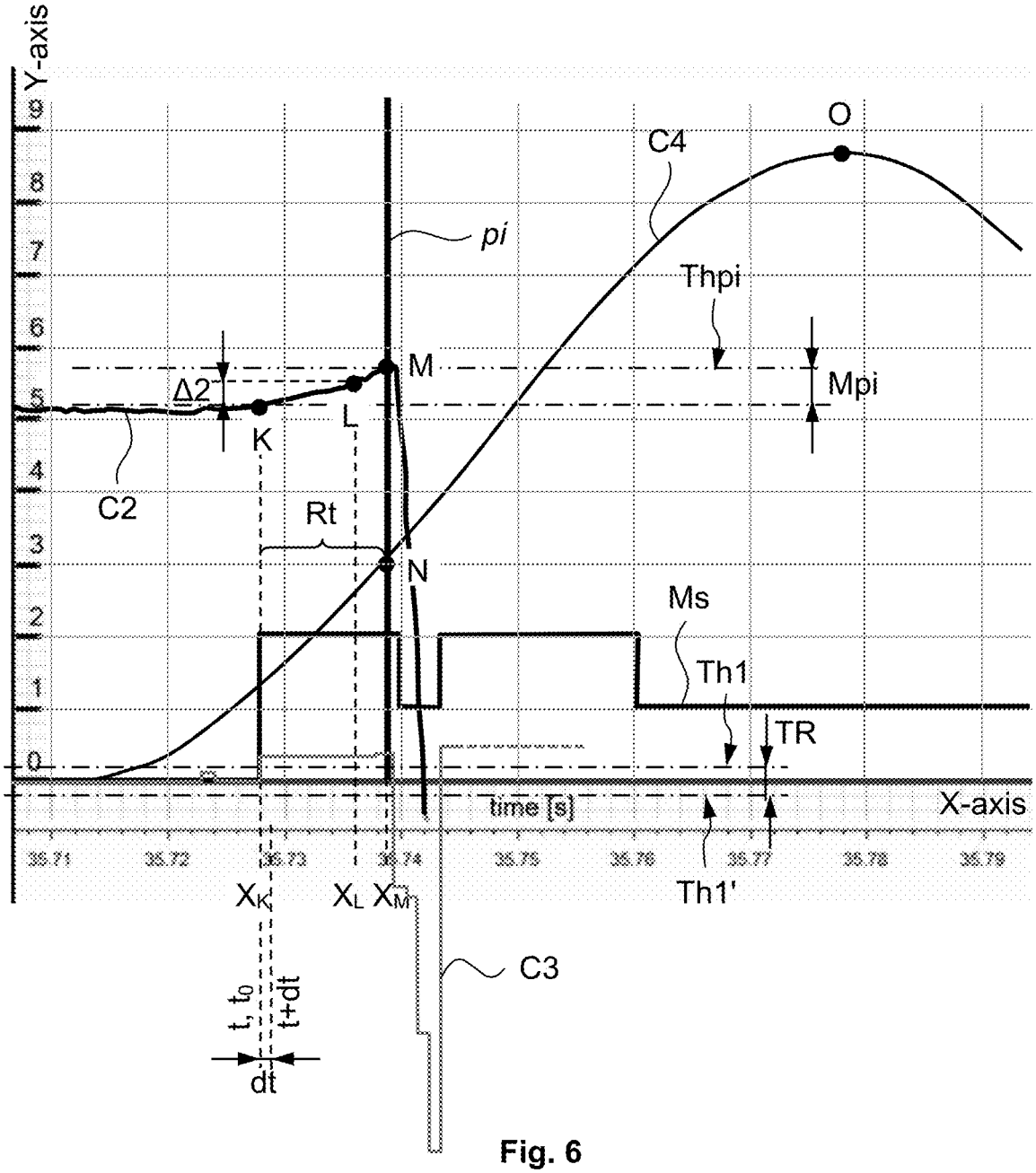
FIG. 6 is a detailed portion of a graph mainly showing the armature current rising until a potential pinch is detected, and FIG. 7 provides a schematic representation of a pinch detector for implementing the method of the present solution, as well as a vehicle comprising such a pinch detector and a computer-readable medium comprising instructions for causing a processor to execute the method of the present solution.

The graphs of FIGS. 5A, 5B and 5C are presented in register with each other, that is their Y-axis are superimposed or aligned on the same origin on the X-axis, and both the scale and the values on the X-axis are the same for each of the graphs shown in these three Figures. Therefore, these graphs are advantageously presented with a good consistency with each other.

FIG. 5A shows the variations of the armature current ia along the time domain X-axis in seconds. More specifically, this graph shows a time interval comprised between the instants t=61.5 sec and 64 sec. On the Y-axis, the armature current varies between 0 A (i.e. Amperes) and approximately 16 A. This is shown through the curve C2 in FIG. 5A. Shortly after t=61.5 sec, the current ia quickly rises from zero to approximately 8 A. This may correspond to a transient phase of the electric motor when its starts to actuate the powered panel 1. Then, the value of the armature current ia remains almost constant until time t=63.35 sec (panel position $X_B$) where it rises before falling to zero at t=63.85 sec (panel position $X_F$).

FIG. 5B shows another curve, denoted C3, which represents the local variations of the curve C2 shown in FIG. 5A, namely the local variations of armature current ia within the time domain X-axis. The local variation of the armature current ia is denoted Δ1 and can be determined by comparing the currently measured value of the armature current ia at an instant t with the armature current ia at a previous instant t−dt, where dt is the time interval between the current instant t and the previous instant. Accordingly, dt may be regarded as a time step size for monitoring the variations Δ1 of the physical quantity ia (in the present case). Mathematically, one can write that Δ1=ia(t)−ia(t−dt), namely Δ1=q(t)−q(t−dt) on a generalized basis knowing that the physical quantity q may be different from the armature current ia.

When comparing the curves C2 and C3 of FIGS. 5A and 5B respectively, one can note that the rising of the armature current ia occurring shortly after t=61.5 sec in FIG. 5A, is represented in FIG. 5B by a significant local variation Δ1 of the armature current. More specifically, this variation reaches almost 2 A (i.e. Amperes) as shown through the peak surrounded by the circle labelled "A" in FIG. 5B. This peak shows the size or magnitude of the armature current variation Δ1, so that when the curve C3 of the peak decreases, it means that the variation Δ1 becomes less important than before.

FIG. 5B also shows two horizontal lines extending along the time domain X-axis, respectively above and below the zero level. Each of these horizontal lines defines a first threshold value denoted Th1 and Th1'. The distance, in the Y-axis direction, between these two lines (or first threshold values) defines a tolerance range TR (or a margin) within which the variations Δ1 are so small that they can still be considered as negligible.

At time t=63.35 sec ($X_B$), one can note that the curve C3 crosses the first threshold value Th1 at a point labelled "B" in FIG. 5B. One can also note that once the curve C3 is no longer within the tolerance range TR, it means that the armature current ia either increases or decreases. Between points B and C, the curve C3 is above the (upper) first threshold value Th1 which means that the armature current ia is rising. That can be shown in the corresponding portion of the graph of FIG. 5A. Then, between points C and E, the armature current ia is again considered to be constant since it comprised within the tolerance range TR, namely between the levels provided by the first threshold values Th1 and Th1'. Finally, the armature current ia decreases between points E and F given that the variation Δ1 is negative and is below the (lower) first threshold value Th1'. It should be noted that the first threshold values Th1 and Th1' preferably have the same absolute value but have opposite signs, so that the two horizontal lines depicting these first threshold values are symmetrical relative to the X-axis at the origin (i.e. at Y=0). However, the first threshold values Th1 and Th1' may differ in absolute value.

From the variations Δ1 of the monitored physical quantity (ia in the present case), one can determine a so-called monitoring signal Ms as shown in FIG. 5C. When the variations Δ1 are comprised within the tolerance range TR, the monitoring signal Ms is set to 0 (zero). When the variations Δ1 are positive and no longer considered constant (i.e. are greater or equal to the first threshold value Th1), the monitoring signal Ms is set to 2, as shown e.g. between points B and C in the circle labelled "D" in FIG. 5C. Finally, when the variations Δ1 are negative and no longer considered constant (i.e. are below the lower first threshold value Th1'), the monitoring signal Ms is set to 1, as shown e.g. between points E and F. Thanks to the monitoring signal Ms, one can follow the variations Δ1 of the physical quantity monitored during the panel movement, and translate these variations into three basic states, namely a constant state (Ms=0), a rising state (Ms=2) and a falling state (Ms=1).

FIG. 6 shows in more details an example of a pinch detection pi detected within the time domain X-axis on the basis of a lack of steadiness of the armature current ia taken as example of the monitored physical quantity q. The curve C2 still corresponds to the depiction of the armature current ia within the time domain. Moreover, the monitoring signal Ms has been added in the same graph as well as a pinching curve C4 depicting the variation of the pinching force that may be caused by a powered car window 1 on an obstacle 4 when the later is pinched e.g. between the upper edge of the window and its frame 2 as shown in FIG. 1. The pinching curve C4 is provided in this graph for information purposes, since the signal represented by the pinching curve C4 is issued from a dedicated device (pinch meter) during works made on a test bench for developing and testing anti-pinch algorithms according to the present solution.

The rounds R may be depicted by the measurements of the armature current ia within the time domain X-axis. Indeed, each time a new round R is started, the physical quantity is measured according to the main step 1 of the round of the method. Accordingly, if a measurement is made at a time t, the next measurement, if any, will occur at the next round, i.e. at time t+dt. In FIG. 6, the time interval dt is not represented at a true scale, so that in real life it is preferably finer in order to get a better accuracy. In practice the time interval dt is typically defined by the clock frequency of the integrated circuit designed to execute the rounds. However, the time interval dt may be determined on another basis, in particular if it is not necessary to have such frequent measurements.

The first critical point shown in FIG. 6 is point K located at the curve C2 Indeed, at point K the curve C3 rises beyond the first threshold Th1, thus going beyond the margin defined by the tolerance range TR. Accordingly, the monitoring signal Ms switches from the value 0 to value 2 in order to indicates the lack of steadiness in the armature current, more specifically to indicate that the armature current ia is regarded as rising from point K. Since the lack of steadiness was not present during the previous round $R_{-1}$, therefore at least one current parameter q(t), t specific to the panel movement at the present time t is stored as a reference value $q_0$, $t_0$ (see main step 3 of the round). In the present case of FIG. 6, the reference value $q_0$, $t_0$ may respectively store the armature current ia(t) at point K and the time t at this same point K ($X_K$).

Then, in the example of FIG. 6, the execution of the rounds R continues along the time domain (X-axis) in order to check if a potential pinch pi is detected. According to the main step 3, this is achieved by calculating the second difference Δ2 between the current parameter q(t), t, i.e. the parameter q(t), t as it appear at the present time, and the reference value $q_0$, $t_0$ previously stored. Mathematically, the second difference can be written by the following expression: $\Delta 2 = q(t) - q_0$ or $\Delta 2' = t - t_0$ depending on which parameter q(t) or t is considered. Such a second difference Δ2 is shown at point L in FIG. 6.

Then, the rounds R are successively executed until a potential pinch pi is detected, i.e. in this case shortly after instant t=35.738 sec ($X_M$) corresponding to point M. Indeed, at point M, the second difference Δ2 is greater than or equal to the pinching threshold value Thpi, Thpi'. The pinching threshold value Thpi, Thpi' may be regarded as a limit located at one extremity of a margin Mpi which, at the opposite of the value Thpi, Thpi', is delimited by one of the first threshold value Th1, Th1', more particularly by the closest first threshold value which is Th1 in the present case.

Still referring to FIG. 6, one can note that the time duration between point K and M is denoted Rt and corresponds to a so-called rising time within the time domain X-axis. In the present example, one can also note that the pinching force at the end of this rising time Rt, namely at point N, is much lower that the pinching force at point O which corresponds to the force applied onto an obstacle in a car window at the moment where the panel 1 effectively stops. The time interval between points N and O corresponds to the required time for the panel to stop, due to its kinetic energy and inertia, from the instant where the pinch pi has been detected (point M). In addition, one can note that the rising time Rt is very short since it is about 0.01 sec. This rising time Rt corresponds to the time interval required to detect a potential pinch pi. Accordingly, thanks to the very short time interval Rt it is possible to get a pinching force (point O) that is under 100 N, namely below the maximum allowed value usually authorized by guidelines. Therefore, one can note that the present solution is particularly efficient for detecting potential pinches, even with very restrictive specifications in terms of reactivity and pinching force threshold value.

For information purposes, the graphs shown in FIG. 6 have been obtained under the following conditions: battery voltage: 16V, stiffness ko of the obstacle: 65 N/mm, thickness of the obstacle: 60 mm, location of the obstacle: middle of the window width. In addition, the pinching force reported through the curve C4 should be read by applying, to the scale values of the Y-axis, a multiplication factor equal to 10, so that the pinching force that could be applied onto the obstacle 4 at point O is equivalent to 87 N, i.e. under the above-mentioned maximum value of 100 N. Other tests have been made under different conditions, especially using different voltages for energizing the motor (e.g. a battery voltage of 10V), different stiffness of the obstacle (e.g. ko limited to 5 N/m) and different positions of the obstacle 4 along the width of the window 1. Even using such values as extreme cases, it was efficiently possible to detect a pinch pi in a range always much below the critical value reaches at point O.

Other Embodiments

As shown and discussed in connection with FIG. 2, the time or panel position domain has first exclusion zones which have been referred to as blind zones Bz1, Bz2. Each of these first exclusion zones Bz1, Bz2 is at least bounded by one of the extremities of the time or panel position domain X-axis. This time or panel position domain may further have second exclusion zones which have been referred to as transient zones Tz1, Tz2. Each of these second exclusion zones Tz1, Tz2 is at least bounded by one of activation the powered movable panel and the deactivation of the powered movable panel, i.e. by the instant t or position X (in the time or panel position domain) which corresponds to the moment when the powered movable panel 1 is turning on (Tz1) and/or turning off (Tz2).

According to one embodiment, within at least one of the first exclusion zones Bz1, Bz2, and preferably within at least one of the second exclusion zones Tz1, Tz2, the execution of the round R is suspended. In other words, the method of the present solution may prevent the execution of the round R in any of at least one of the exclusion zones. Indeed, since the physical quantity such as the armature current ia is significantly perturbed for several reasons in the first and second exclusion zones Bz1, Bz2, Tz1, Tz2, it may be preferable to avoid taking into account values (i.e. measurements) in these particular zones. Accordingly, the measurement of the physical quantity q is preferably prevented in these particular zones. The circle labelled "A" in FIG. 5B shows an example of such a perturbation caused by the activation of the motor used to move the panel when it is turned on.

Preferably, one of the first exclusion zones (i.e. Bz2) extends over a range of 4 mm from the closed position P2, more specifically from the fully closed position of the movable panel 1. Such an exclusion zone may relate to a situation shown in connection with FIGS. 5A, 5B and 5C. Indeed, at panel position $X_B$, the movable panel 1 is touching the top frame 2 (FIG. 1), so that the armature current ia of the motor is increasing up to 18 A. During the time interval between $X_C$ and $X_E$, the armature current reaches the highest level while being almost steady. In this time interval the armature current is named stall current. During stall current, the motor generates the highest torque and the rotational shaft speed is zero to completely close the panel 1.

If any, i.e. if applicable, the other first exclusion zone (i.e. Bz1) extends over a range from the open position P1, in particular from the fully open position of the movable panel 1, which preferably does not extend beyond 200 mm from the closed position P1, in particular from the fully closed position. These ranges of values (4 mm and 200 mm) allow to comply with standards required by some countries while ensuring a correct operation of the anti-pinch mechanism. Depending on the manufacturer or client requirements, the aforementioned other first exclusion (i.e. Bz1) may extend e.g. over a range of 50 mm from the fully open position P1 or may even be reduced to zero.

Preferably, one of the second exclusion zones (i.e. Tz1) extends over a range equivalent to 0.2 to 0.5 seconds from the activation of the powered movable panel 1 (i.e. from the moment the panel is activated). These time intervals, which may be converted into any other suitable unit in the time of panel position domain, provides ranges to avoid taking into account values of the physical quantity in transient states of the actuator (especially the motor) of the movable panel (like shown in circle labelled "A").

In another embodiment, measuring the physical quantity q when the panel 1 is moved towards the closed position P2 is carried out on a continuous basis or almost continuous basis, namely as fast as possible. The processing speed typically depends on the clock of the integrated circuit used for performing the rounds R. Nevertheless, if it is preferable to monitor the closing movement of the panel in a continuous way or with a fine step size for safety reasons, it should be noted that may be not necessary to measure the physical quantity q as fast as the integrated circuit would allow, especially if this integrated circuit would support very high processing speed. In such a case, computing resources may be saved while ensuring a sufficient measuring speed of the physical quantity q during the panel movement towards its closed position P2. In addition, it should be noted that monitoring the closing movement may be performed according to different step size depending on the position of the panel 1 in the time or panel position domain. For example, within a critical position interval such as in a range between 200 mm and 4 mm from the frame 2 located in front of the edge of the panel 1 when it is fully closed, the measurements of the physical quantity q may be performed according to a step size which may be finer than that applied outside such a range. This may further help to save computing resources.

Physical Quantity

According to the preferred embodiment, the physical quantity q is the armature current is of an electric motor 5 (FIG. 7) used to operate the panel 1. In this case, the "lack of steadiness" mentioned in the main steps S2 and S3 (under the chapter entitled "Main steps of the method") may be replaced by another wording such as "increase". This is due to the fact that any pinching necessarily involves a rising in the armature current ia of the electric motor 5. In contrast, if the rotational speed of the electric motor is taken as physical quantify q, any pinching will result in a decrease in motor speed. In such a case, the aforementioned "lack of steadiness" mentioned in the main steps S2 and S3 should be replaced by a wording such as "decrease" and the test performed at the main step S4 regarding the second difference Δ2 should be to know if Δ2 is lower than or equal to the pinching threshold value Thpi, Thpi', instead of greater than or equal to this value Thpi, Thpi'. Furthermore, the pinching threshold value Thpi, Thpi' would be in this case below the first threshold value Th1' instead of being above the value Th1 (see FIG. 6).

In the case where the physical quantity q is the armature current ia, the main step S2 for determining if there is a lack of steadiness in the physical quantity may be performed by the sub-steps S2.1 to S2.2 shown in FIG. 4A. At least a part of these subs-steps may be performed by the processing device 18 shown in FIG. 7 and described in connection with the second aspect of the present solution.

The first sub-step S2.1 aims to calculate a first difference Δ1 between the physical quantities is measured at two successive rounds R, $R_{-1}$, e.g. so that Δ1=ia(t)−ia(t−dt). Preferably, the previous round $R_{-1}$ is the closest previous round relative to the current round R. Alternatively, the so-called previous round $R_{-1}$ could be further away (e.g. $R_{-2}$, $R_{-3}$) from the current round R. In another alternative, the so-called previous round $R_{-1}$ could be determined on the basis of an average of some previous rounds (e.g. $R_{-1}$, $R_{-2}$, $R_{-3}$) relatively close to the current round. Similarly, the current round R may be an average of some recent rounds (e.g. R and $R_{-1}$) and the so-called previous round may be an average of other recent rounds (e.g. $R_{-2}$ and $R_{-3}$).

The second sub-step S2.2 of the main step S2 aims to determine that there is a lack of steadiness if the aforementioned first difference Δ1 is greater than or equal to the first threshold value Th1 and, if not, a new round R is executed. If Δ1≥Th1, the round R continues to the step S3. It should be noted that the second sub-step S2.2 may be worded differently, for example using a expression such as determining if the first difference Δ1 is within the tolerance range TR (see FIG. 6) and, if not, continuing to the step S3.

In one embodiment the physical quantity q is the panel movement speed or the actuator speed, in particular the motor speed (i.e. the angular or rotational speed of the rotor shaft), instead of the armature current ia of the electric motor used to operate the panel 1. Given that such a speed will necessarily decrease as soon the powered panel 1 meets an obstacle 4, the second difference Δ2 between the parameter q(t), t at the present time t and the reference value $q_0$, $t_0$ should be multiplied by minus one, before being considered, so as to comply with the wording used to define the fourth main step S4 mentioned in connection with the general case covering any kind of physical quantity q. The aforementioned wording "before being considered" preferably means before any further operation involving the second difference Δ2.

Still preferably, if the physical quantity is a speed such as the rotational speed n of the electric motor actuating the powered movable panel 1, the main step S2 for determining if there is a lack of steadiness in the physical quantity n could be performed by the following three sub-steps:

First sub-step S2.1': calculating the first difference Δ1 between the physical quantities n measured at two successive rounds R, $R_{-1}$, e.g. so that Δ1=n(t)−n(t−dt).

Second sub-step S2.2': determining that there is a lack of steadiness if the first difference Δ1 is less than or equal to the first threshold value Th1'; this first threshold value Th1' being a negative value similarly to what is shown e.g. in FIG. 5B. If Δ1>Th1', a new round R is started, otherwise the step S3 is performed. Once again, at least a part of these subs-steps may be performed by the processing device 18 shown in FIG. 7 and described in connection with the second aspect of the present solution.

Further Embodiments

Whatever the physical quantity q, the step S3 for determining if the lack of steadiness was already present during the previous round $R_{-1}$ may be performed by the following two sub-steps shown in FIG. 4A:

The first sub-step S3.1 aims to increment a counting value CT. This counting value CT has been initially reset (e.g. to a value such as zero) during an initialization step S0 at the beginning of the method (see FIG. 6). Incrementing the counting value CT may be performed e.g. using the counter 14 shown in FIG. 7.

The second sub-step S3.2 aims to determine if the counting value CT is greater than a second threshold value Th2, e.g. using a comparator 17 shown in the example of FIG. 7. Such a threshold value Th2 will depend on the counting value CT as set during the initialization step S0. Typically, if CT is set to 0 (zero) during the initialization step S0, the second threshold value Th2 may be set to 1. Generally speaking, the difference between Th2 and CT when the counting value is reset at step S0 is preferably equal to 1. If the counting value CT is greater than a second threshold value Th2, it is determined that the lack of steadiness was already present during the previous round $R_{-1}$. The use of a counting value CT is advantageously easy to implement in an algorithm written using program instructions for causing a processor to execute the round R.

Figure 4B:
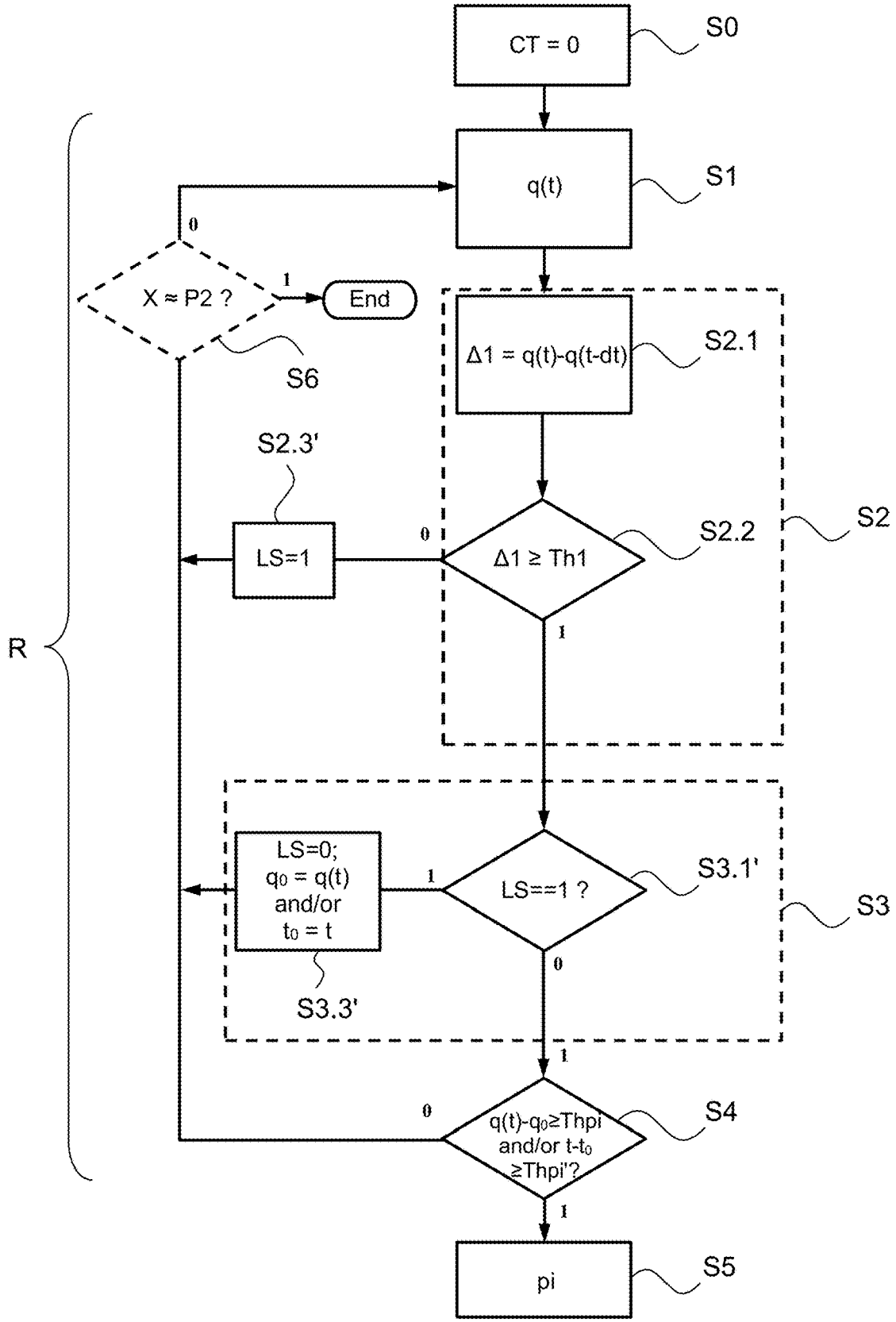

Alternatively, the step S3 may be performed according to the variant shown in FIG. 4B. In this other embodiment, a so-called last stability LS is used as a tag instead of the counting value CT. Accordingly, if the response to the previous test made at sub-step S2.2 is "No" (value 0), it means that the measurements are steady or that no pinch may occur, so that LS is set to 1 at step S2.3'. However, if the response to the previous test made at sub-step S2.2 is "Yes" (value 1), it means that the measurements are no longer steady and that a pinch may occur. Therefore, the first sub-step S3.1' of step S3 aims to check if LS is equal to 1 and, if so, the round continues to sub-step S3.3' in which the last stability value LS is set to 0. Otherwise, i.e. if LS is different from 1, especially equal to 0, the round continues to sub-step S4.

Still referring to FIG. 4A or 4B, the round R may, in one embodiment, further include a step S6 for ending the method if the current position X of the powered panel 1 reaches the closed position P2 or a position close to said closed position P2. Preferably, ending the method is performed if the current panel position X reaches the first exclusion zone Bz2 extending over a range of 4 mm from a fully closed position P2. This step S6 could be performed before starting each round or each new round R. As a reminder, the current panel position X is the panel position within the time or panel position domain X-axis at the present time t, namely at the time where the current round R is executed. The step S6 may be performed e.g. by the processor 18 shown in FIG. 7.

According to a preferred embodiment, as soon as a pinch pi has been detected, the movement of the movable panel 1 is stopped and/or reversed so as to moves it back to the open position P1. This may be performed by the processor 18 for example. Accordingly, the pinching force applied onto the obstacle 4 is immediately released. It should be noted that there is no need to move back the panel 1 to its fully open position P1 when the pinch has been detected, since a slight movement of the panel toward the open position P1 may fully release the pinching force. Still preferably, once the pinching force is released, or after a small time interval from the pinching force release, the movement of the movable panel 1 may be stopped. At this stage, the obstacle could be removed in order to keep the window stroke free of any obstacle.

Second Aspect

According to a second aspect depicted in FIG. 7, the present solution relates to a pinch detector 10 for implementing the aforementioned method according to any of its embodiment, or any possible combination of its embodiments, previously disclosed. Accordingly, the pinch detector 10 implements the method for detecting potential pinches pi caused by at least one powered panel 1. For example, the pinch detector 10 may implement the method for detecting potential pinches pi between a powered movable panel 1 and a fixed frame 2 relative to the aforementioned panel 1. The latter is movable by an actuator 5 in a time or panel position domain X-axis between an open position P1 and a closed position P2. The actuator 5 may typically be an electric motor, e.g. a DC motor. The movable panel 1 is typically a powered window of a vehicle for example.

The pinch detector 10 has a measuring device 12 for obtaining or carrying out measurements of a physical quantity q representative of a panel movement, and a processing device 18 for performing calculation tasks in order to at least: determine if there is a lack steadiness in the physical quantity q relative to the previous measurement (i.e. relative to the measurement of the physical quantity q made at the previous round R−1); determine if the lack of steadiness was already present during the aforementioned previous measurement; and detect a potential pinch pi if the lack of steadiness is greater than or equal to a pinching threshold value Thpi, Thpi'.

The above mentioned calculation tasks that the processing device 18 has to perform may be implemented according to any embodiment or combination of embodiments mentioned in the detailed description of the related method or round steps. Since these tasks relate to calculation tasks, they can advantageously be easily implemented in any processing device, integrated circuit, or chipset.

Once again, it is noted that different wording may be used for defining the pinch detector 10 while providing the same effect. For example, the processing device 18 of the pinch detector 10 may perform calculation tasks in order to determine if there is a steadiness in the physical quantity q relative to the previous measurement, determine if the aforementioned steadiness was already present during the previous measurement, and detect a potential pinch pi in case of a lack of steadiness is greater than or equal to a pinching threshold value Thpi, Thpi'.

The processing device 18 is typically a processor or a chipset which may have at least one memory, e.g. for the temporary storage of calculations values and/or for the permanent storage of predefined values such as threshold values and other parameters for example. The processing device 18 may be further designed to execute program instructions for the implementation of the aforementioned method.

As schematically shown in FIG. 7, the processing device 18 may be provided with several specific devices or entities for performing the calculation tasks. For example, the processing device 18 may have a monitoring device 13 for determining, relatively to the previous measurement, if there is a steadiness or a lack of steadiness in the physical quantity q. It may have a counter 14 for determining if the steadiness or lack of steadiness was already present during the previous measurement. The processing device 18 may also have a detector 15 for detecting a potential pinch if the lack of steadiness is greater than or equal to the pinching threshold value Thpi, Thpi'. The processing device 18 may further have at least one comparator 17 for performing comparisons between values. It should be also noted that at least a part of these devices or entities may be located outside the processing device 18 while being connected to the latter. The processing device 18 may further comprises registers, typically to at least temporarily store data for calculation purposes. In addition, the processor 18 may have capabilities to perform some calculations for determining the physical quantity q, if any. Indeed, the measuring device 12 could obtain intermediate measurements which could be used to determine the physical quantity q. For example, if the physical quantity is a speed that has to be determined using a Hall sensor device, the processor 18 may need to perform some additional calculations to determine this speed from the Hall sensor signal.

Preferably, the pinch detector 10 further comprises a saving device 16, for storing data such a threshold values for instance. The saving device 16 may be a memory, a storage device or a communication means for sending data to a remote storage means. The measuring device 12 may be a device which measures the physical quantity representative of the panel movement or may be a means, such as a communication line, for obtaining the measurements from a remote device via an appropriate signal. Any communication may be exchanged using a communication interface 19 located in the pinch detector 10. The pinch detector 10 may be connected to the actuator 5 or may include the actuator 5 used for moving the powered movable panel 1.

According to a preferred embodiment, the pinch detector 10 generates a control signal 11 for controlling at least one of the two actions of stopping the movement of the powered movable panel 1 and moving the powered movable panel 1 towards the open position P1.

Other Aspects

According to a third aspect, the present solution relates to a vehicle 20 comprising the pinch detector 10 as schematically shown in FIG. 7. Typically, the vehicle 20 is a motor vehicle and the powered movable panel 1 is at least one of a window, a sliding door, and a sliding roof of the vehicle 20.

According to a fourth aspect, the present solution relates to a non-transitory computer-readable medium 30 storing program instructions that, when executed by a computer, cause it to perform the method disclosed in the present description according to any of its embodiments or possible combination of its embodiments.

Although an overview of each of the inventive subject matter has been described with reference to specific example embodiments, various modifications and changes may be made to these embodiments without departing from the broader spirit and scope of embodiments of the solution disclosed in the present description.

What is claimed is:

1. A pinch detector comprising:

a measuring device configured to obtain measurements of a physical quantity representative of a panel movement of a panel, the panel being movable by an actuator in a time or panel position domain between an open position and a closed position, and a processing device configured to perform calculation tasks, the calculation tasks including:

determine whether there is a lack of steadiness in the physical quantity relative to a previous measurement;

determine whether the lack of steadiness was already present during the previous measurement; and detect a potential pinch, responsive to the lack of steadiness being greater than or equal to a pinching threshold value.

2. The pinch detector of claim 1, wherein the pinch detector generates a control signal for controlling at least one of stopping the movement of the panel or moving the panel towards the open position.

3. The pinch detector of claim 1, wherein the pinch detector is included in or on a vehicle.

4. A pinch detector comprising:

a measuring device configured to obtain measurements of a physical quantity representative of a panel movement of a panel, the panel being movable by an actuator in a time or panel position domain between an open position and a closed position, and a processing device configured to perform a round of tasks, the round of tasks comprising:

determine whether there is a lack of steadiness in the physical quantity relative to a previous round;

responsive to a determination that there is not a lack of steadiness in the physical quantity relative to the previous round, start a new round;

responsive to a determination that there is a lack of steadiness in the physical quantity relative to the previous round, determine whether the lack of steadiness was already present during the previous round;

responsive to a determination that the lack of steadiness was not already present during the previous round, store at least one current parameter specific to the panel movement as a reference value and start the new round; and responsive to a determination that the lack of steadiness was already present during the previous round:

detect a potential pinch in response to a second difference between the at least one current parameter at a present time and the reference value being greater than or equal to a pinching threshold value; or start the new round in response to the second difference between the at least one current parameter at the present time and the reference value being less than the pinching threshold value.

5. The pinch detector of claim 4, wherein the time or panel position domain has at least one of:

one or more first exclusion zones that are at least bounded by one of extremities of the time or panel position domain; or one or more second exclusion zones that are at least bounded by an activation of the panel, the activation of the panel resulting in an execution of the round being suspended.

6. The pinch detector of claim 5, wherein:

at least one first exclusion zone extends over a range of 4 mm from a fully closed position; and another first exclusion zone extends over a range from a fully open position to the fully closed position, the fully open position not extending beyond 200 mm from the fully closed position.

7. The pinch detector of claim 5, wherein at least one second exclusion zone extends over a range equivalent to 0.2 to 0.5 seconds from the activation of the panel.

8. The pinch detector of claim 4, wherein measuring the physical quantity as the panel is moving towards the closed position is carried out on a continuous basis.

9. The pinch detector of claim 8, wherein the physical quantity is an armature current of an electric motor used to operate the panel.

* * * * *